US007509919B2

(12) United States Patent
Sebellin

(10) Patent No.: US 7,509,919 B2
(45) Date of Patent: Mar. 31, 2009

(54) DEEP WATER INSTALLATION VESSEL

(75) Inventor: Eric Sebellin, Nice (FR)

(73) Assignee: Single Buoy Moorings, Inc. (CH)

( * ) Notice: Subject to any disclaimer, the term of this patent is extended or adjusted under 35 U.S.C. 154(b) by 0 days.

(21) Appl. No.: 11/703,278

(22) Filed: Feb. 7, 2007

(65) Prior Publication Data

US 2007/0193496 A1 Aug. 23, 2007

Related U.S. Application Data

(60) Provisional application No. 60/774,285, filed on Feb. 17, 2006.

(51) Int. Cl.
*B63B 35/44* (2006.01)

(52) U.S. Cl. ..... 114/258

(58) Field of Classification Search ..... 114/268, 114/258–262

See application file for complete search history.

(56) References Cited

U.S. PATENT DOCUMENTS

| | | | | |
|---|---|---|---|---|
| 3,889,621 | A | 6/1975 | Pease | |
| 4,273,067 | A * | 6/1981 | Lloyd, III et al. | 114/258 |
| 4,458,631 | A * | 7/1984 | Hystad | 114/199 |
| 5,655,753 | A | 8/1997 | Berges et al. | |
| 6,003,466 | A | 12/1999 | Dove et al. | |
| 6,009,825 | A | 1/2000 | Fulton et al. | |
| 6,122,847 | A | 9/2000 | Treu et al. | |
| 6,352,388 | B1 * | 3/2002 | Seguin | 405/166 |
| 6,397,951 | B1 * | 6/2002 | Roberts | 166/380 |
| 2002/0129755 | A1 | 9/2002 | Hagen et al. | |
| 2003/0044235 | A1 | 3/2003 | Stockstill | |
| 2003/0044240 | A1 | 3/2003 | Bergeron | |

FOREIGN PATENT DOCUMENTS

| | | |
|---|---|---|
| EP | 1 265 017 A1 | 12/2002 |
| GB | 2 338 220 A | 12/1999 |
| NL | 8400253 | 8/1985 |
| NL | 9001535 | 2/1992 |

* cited by examiner

*Primary Examiner*—Stephen Avila
(74) *Attorney, Agent, or Firm*—Leon D. Rosen

(57) ABSTRACT

An installation vessel has upper and lower decks (40, 50) that are vertically spaced about 3 meters apart, with most of the lower deck covered by the upper one, but with a rear portion (60) of the lower deck being uncovered. The upper deck is used primarily for storage, while the lower deck is the one used for installation of anchor chains, wires, ropes, etc. that pass from a winch (81) to a stern roller (84) at the rear of the lower deck, so dangerous conditions of chains, wires, ropes, etc. moving along a deck during installation are confined to the lower deck. A main crane (72) that lies on one side of the vessel, lies forward of the rear end of the upper deck at a location wherein the crane can reach all portions of the uncovered lower deck portion and most of the upper deck.

6 Claims, 2 Drawing Sheets

DEEP WATER INSTALLATION VESSEL

CROSS-REFERENCE

Applicant claims priority from U.S. provisional patent application Ser. No. 60/774,285 filed Feb. 17, 2006.

BACKGROUND OF THE INVENTION

Installation vessels are used to install items during the setup of a hydrocarbon production system that produces hydrocarbons from the sea floor, a system where hydrocarbons are transferred to or from a shore-based installation, and other offshore systems especially for hydrocarbon transfer and well maintenance. These include installations where a floating body is held by chains extending from a turret or by spread mooring. The installation vessel installs items on the sea floor, including anchors, piles, manifolds, subsea trees (wellheads), templates and pumps, items that are to lie at a height between the sea floor and the sea surface such as buoyancy tanks that are to be attached to risers, and other in-sea items or tools including cables, chains, and underwater hammers. A conventional installation vessel has a single work deck extending from the stern of the vessel to about halfway to the bow. The limited space on the work deck limits the amount of materials, equipment and tools that can be stowed. The space is limited especially because space must be left between winches and a stern roller, between which elongated elements such as cables, chains and hoses are rapidly moved into or out of the sea. The rapidly moved elongated elements create a danger to personnel working on the deck.

Considerable material is usually placed at a mobilization harbor that is close to the installation site. A conventional installation vessel sails a long distance to a mobilization harbor that is located near where a system is to be installed, maintained, etc. The installation vessel has to interrupt the installation work one or more times during an installation, to sail to the mobilization harbor to pick up materials and equipment that could not be taken on board earlier because of the limited storage space on the vessel. Only after the loading and sailing back is completed, can the installation work be continued. Another ship cannot perform the transportation, because this would require the transfer of the material and equipment to the installation vessel at sea, which is normally too risky.

The above-described problems are especially relevant for installations in deep waters, which are normally located much further offshore and therefore at larger distances from the mobilization harbor. Also, the installation packages that include equipment and modules to be installed in deep water are usually much larger in size and weight than for waters of moderate depth.

SUMMARY OF THE INVENTION

In accordance with one embodiment of the present invention, an installation vessel is provided that has an unusually large amount of deck space for a hull of given length and width, and that confines a dangerous area where there is rapid movement of elongated members along a deck and into or out of the sea, to a limited deck area. The installation vessel includes a hull and an upper working deck at the top that has a large flat deck area where material and equipment can be easily stored and moved around. The vessel also has a lower working deck that lies at least 1.8 meters below the upper deck and that provides considerable additional deck working area. The upper deck lies directly above a portion of the lower deck, and the lower deck has an uncovered portion extending to the periphery of the vessel where chains, risers, flowlines, etc. can be moved into or out of the sea. Equipment for moving chains etc. into or out of the sea is located on the lower deck so corresponding dangers are confined to the lower deck, and the upper deck is left as a relatively safe area where materials and equipment can be stored more densely and can be more easily moved.

Applicant prefers to locate the uncovered, or open portion of the lower deck at the rear of the vessel, with the upper deck having a rear end located a plurality of meters and preferably at least ten meters forward of the vessel stern. This locates the region where chains etc. are dropped or pulled up, at the stern where there is less likely to be danger to the vessel. The upper and lower decks preferably extend across the entire width of the hull. The lower deck is preferably devoid of columns to support the upper deck, to avoid interruptions in the wide space over the lower deck. A large crane for lifting heavy items, is located a short distance forward of the upper deck rear end, and can extend to lift item anywhere on the uncovered lower deck portion and on most of the upper deck. The vessel has a moon pool that extends upward though the bottom of the hull and the lower deck. The upper deck has a removable deck portion so items such as riser sections, can be deployed though the upper deck and down though the moon pool into the sea.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
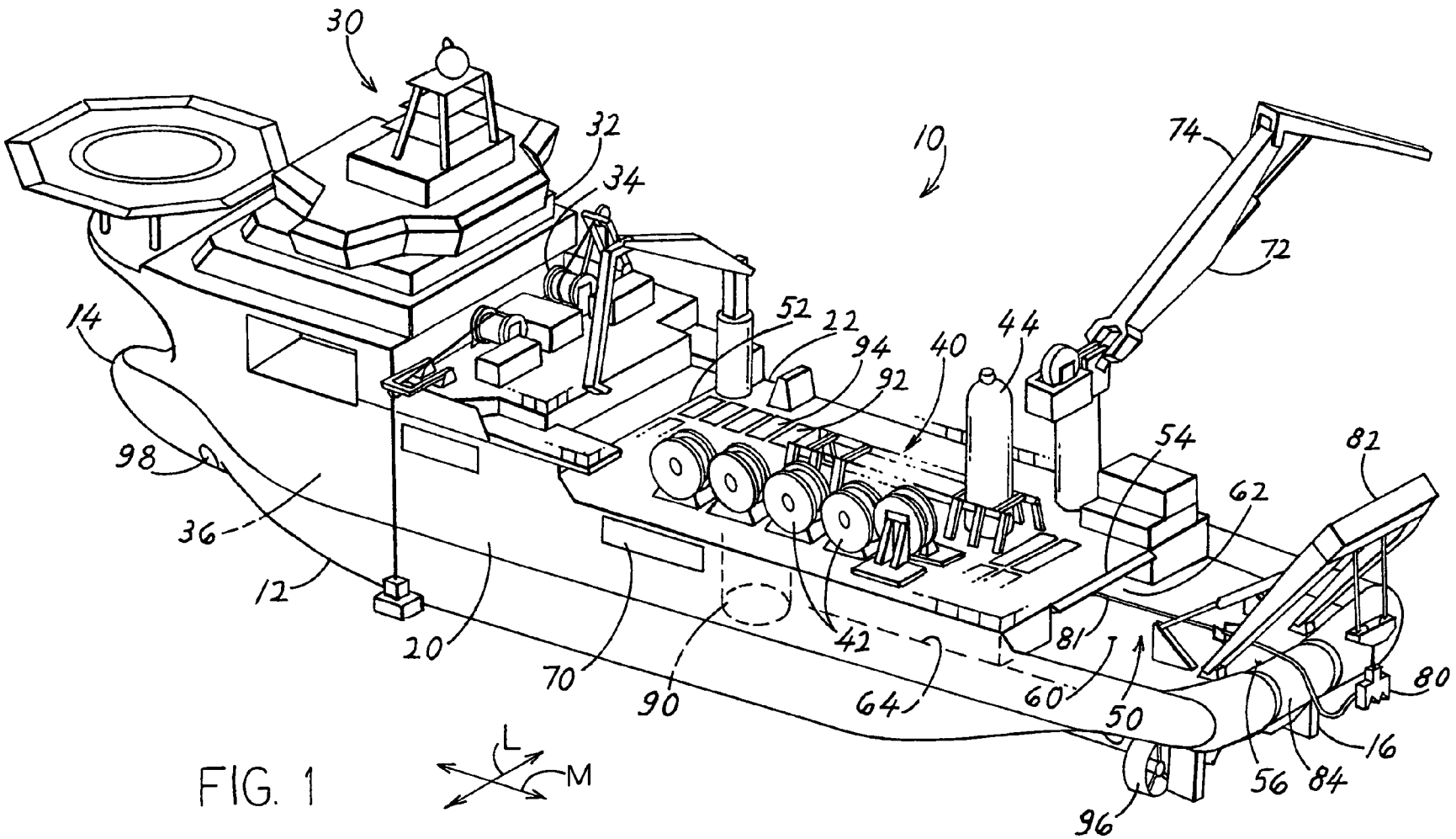
FIG. 1 is a rear, left side, and top isometric view of an installation vessel of the present invention.

FIG. 1 illustrates an installation vessel 10 which includes a hull 12 having a bow 14, a stern 16, and port and starboard sides 20, 22 that form the periphery of the vessel. The front portion 30 of the vessel is occupied by a helicopter deck, a navigation bridge, control rooms and crew quarters, ROV (remotely operated vehicles), heavy duty winches 34 for ROV handling and control rooms for them, and other heavy equipment. Below-deck portions 36 of the vessel are occupied by fuel tanks, engines, chain lockers and other heavy equipment. All of the foregoing equipment is stored in the installation vessel when it is outfitted to ready it to sail what may be a long distance, to a mobilization harbor that is located near the site where the installation will occur. At the mobilization harbor, supplies that will be used up in the installation, and specialized installation equipment for the particular site, are loaded onto the vessel, and the vessel sails to the installation site. The installation site may be where a hydrocarbon production system, a hydrocarbon transfer system, or other major system is to be installed.

The vessel has two decks with parallel flat deck surfaces, instead of the usual one deck. An upper deck 40 lies at the top of the rear half of the hull, and is used primarily to store heavy equipment including reels 42 that hold mooring wires or hoses, suction anchors, or tall wrappings 44 that hold long rigid elements such as piles or pipe sections, and other supplies. In accordance with the present invention, the vessel has a lower deck 50 that lies below the level of the upper deck 40. Both decks are horizontal in a quiescent vessel orientation. The upper deck 40 has a front end 52 lying at about the middle of the vessel length in a longitudinal direction M, and has a rear end 54 lying a plurality of meters, and generally more than ten meters, forward of the stern 16 of the vessel. The lower deck 50 has a rear end 56 lying at about (within 4 meters of) the stern of the vessel. The lower deck 50 has a region extending from the vessel middle at 54 to the rear end 56, with a majority of such region being covered by the upper deck 40. As a result, the lower deck has an uncovered rear portion 60 with a large open space so equipment can be lowered directly onto the lower deck rear portion and lifted up off the rear portion, and there is almost no limit to the height of equipment on the rear portion of the lower deck. The upper deck has a flat surface extending over most of its area so equipment can be easily moved onto and along it, in the same manner as prior art decks. The difference from prior art decks is that the upper deck is somewhat shorter than prior art decks for a vessel hull of the same size.

The lower deck has an entrance 62 that lies under the rear end 54 of the upper deck and that leads to a covered lower deck portion 64. The clear height (H, FIG. 2) above the lower deck, that is, the height of equipment that can lie on and be moved along the lower deck covered portion without hitting beams holding up the upper deck, should be at least 1.8 meters. This allows a man of about average height (wearing shoes and a helmet) of 1.8 meters (6 feet) to walk on the front covered portion 64 of the lower deck that lies under the upper deck, without stooping. Actually, applicant prefers to leave a space of at least 2.6 meters height above the flat walking surface, so materials of up to 2.5 meters height can be moved on the lower deck, with a preferred height of about 3 meters. There is a standard height of a maximum of 2.5 meters for most equipment and supplies that will be stowed or shipped in a vessel. Providing a height of at least 2.6 meters allows such equipment and supplies, such as shown at 66 in FIG. 2, to be moved around and stored on the lower deck.

FIG. 1 shows the possibility of a closeable and sealable door 70 of a height of about that of the lower deck, though which equipment and material can be moved onto and off the covered portion of the lower deck. Of course such a door is not necessary for an upper deck, but is useful to load and unload supplies that are stored near the front end of the covered portion of the lower deck.

The vessel contains several cranes. A main crane 72, with the largest lifting capacity (e.g. 250 tons) and longest boom 74 (when fully extended), lies near the rear end of the upper deck. The crane can lift items anywhere on the uncovered rear portion 60 of the lower deck and on most of the upper deck. Because of the large load that the main crane can lift, it extends down through the lower deck. Otherwise, the covered portion of the lower deck is free of columns that would interrupt it. The upper and lower decks each extends between the opposite sides of the vessel. The lower deck may hold a large amount of stores at its sides, in the covered section of the lower deck.

FIG. 1 shows an anchor 80 lying at the end of a line or chain 81 and held by an A-frame 82 whose upper end lies over the sea behind the stern of the vessel. The anchor is not used for the installation vessel, but for a floating body that will be anchored to the sea floor. A stern roller 84 that lies at the rear of the lower deck is used to facilitate movement of elongated members such as chains, hoses, wires, etc. that are moved between the lower deck and the sea. A main winch 86 (FIG. 2) is used to move elongated members 81 (FIG. 1) such as chains, wires, etc. between itself and the stern roller 84. Hoses and wires are normally stored on rolls, while chains are normally stored in a chain locker in the vessel, and all can be controlled during deployment from the vessel to the sea by the main winch. The upper rotating surface of the stern roller lies within a meter of the height of the lower working deck. There is a clear space extending along the lower working deck to allow chains, hoses, wires and other elongated members to extend from the winch 86 to the stern roller without interference. It can be seen in FIG. 2 that a majority of the moving member 81 (FIG. 1) that moves between the main winch 86 and the stern at stern roller 84, lies below the upper deck 40.

The vessel has a moon pool 90 (FIG. 1) that extends though the bottom of the hull and through the lower deck. A front part 92 of the upper deck has removable floor parts 94, which forms an even surface and that can be removed to gain access to the moon pool though the upper deck and to gain vertical access to the front of the covered deck portion.

Figure 2:
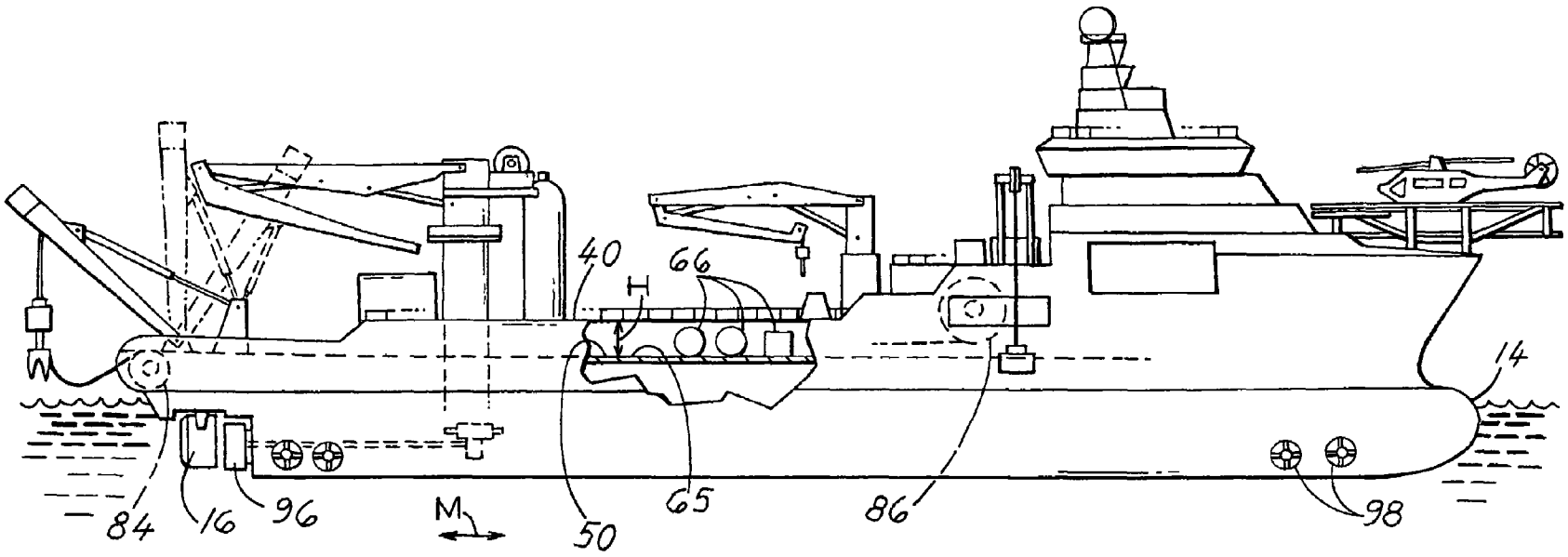
FIG. 2 is a right side sectional view of the vessel of FIG. 1, with the crane having been moved to a stowed position.
Figure 3:
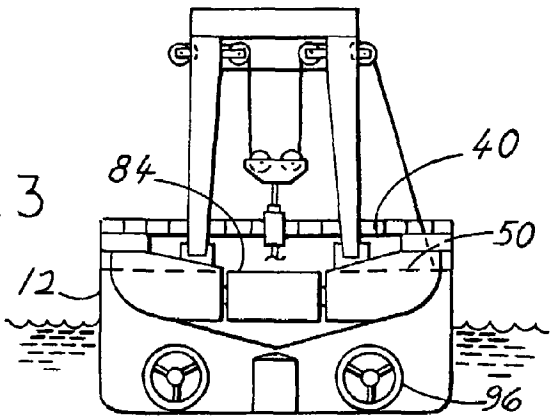
FIG. 3 is a rear elevation view of the vessel of FIG. 2, showing only the A-frame for the sake of clarity.

Applicant has designed a vessel of the construction illustrated, which had a length between bow 14 and stern 16 of one hundred twenty meters and a maximum lateral L width between its opposite sides 20, 22 of twenty-eight meters. The upper deck 40 had a length in a longitudinal direction M of forty-five meters and a lateral L width of twenty-eight meters. The lower deck covered portion 64 had a length of forty-five meters, and the lower deck uncovered portion 60 had a length of twenty meters, with both having a lateral L width of twenty-eight meters. Since the front end 52 of the upper deck lay at the middle of the vessel length, the upper deck had a length of 45 meters, and the open lower deck portion had a length of 80 meters, the upper deck therefore extended along a majority of the length of the rear half of the vessel. The upper deck had an area of 1300 $m^2$ while the lower working deck had an area of about 1700 $m^2$ (not including the moon pool). The vessel is useful for deep water installations and field maintenance. FIG. 2 shows propellers 96 and thrusters 98 for propelling the vessel and holding its position without the need for an anchor and anchor chain or for mooring lines.

Thus, the invention provides an installation vessel of given hull size, that can hold more equipment and materials than a previous vessel with that size of hull, including heavy items that are best raised and lowered by a heavy crane and moved along a flat deck space. The vessel also has a clear space through which chains, wires, etc. can move into the sea. This is accomplished by constructing the vessel with upper and lower decks having parallel flat deck surfaces, with the upper deck having a rear end lying a plurality of meters and preferably more than 10 meters forward of the vessel stern. As a result, the lower deck has an uncovered area at the rear of the vessel where heavy and tall items can be lowered into the sea floor and raised therefrom and onto which heavy items can be lowered and raised by a crane.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An installation vessel which includes a hull with a periphery formed by bow and stern ends and port and starboard sides, wherein said vessel has an upper working deck with a flat working surface area of at least one hundred meters$^2$, wherein:

said vessel has a lower working deck with a flat working surface area of at least one hundred meters$^2$, said lower working deck having a covered lower deck portion of an area of at least one hundred meters$^2$ lying at least 1.8 meters directly below said upper working deck, and said lower deck having an open lower deck portion which extends rearward beyond said upper working deck and which has an area of at least one hundred meters$^2$ that extends to the periphery of the vessel hull;

said bow and stern ends form longitudinally spaced vessel front and rear ends, said vessel has a middle lying halfway between said vessel front and rear ends, and said vessel has a rear half extending longitudinally from said middle to the rear end of the vessel;

said upper deck extends rearward of said vessel middle by a length that is a majority of the length of the rear half of the vessel, and said open lower deck portion extends at least 10 meters rearward of said upper deck rear end.

2. The installation vessel described in claim 1 including:

a main crane that has a crane bottom that lies on one side of said vessel at a location forward of the rear end of the upper working deck, said crane having a crane lifting end that has the capacity to lie over any portion of said open lower deck portion.

3. The installation vessel described in claim 1 wherein:

said hull has a closeable door lying in one side of said hull, which leads to a location on a front of said lower working deck which lies under said upper deck and which is closer to the front of the lower working deck than to the front of the open lower deck portion.

4. The installation vessel described in claim 1 wherein:

said vessel has a moon pool that extends through the bottom of the hull through the lower working deck;

said upper working deck has an even floor, said floor having removeable floor parts that lies over said moon pool.

5. The installation vessel described in claim 1 including:

a stern roller mounted at a rear of the lower deck, and at least one movable line which extends under said upper deck along a majority of the length of said rear half of the vessel and along the lower working deck around a winch and around the stern roller and into the sea, but the upper working deck is devoid of a mooring line movable along the upper working deck along a majority of the length of the rear half of the vessel into the sea.

6. An installation vessel which has longitudinally spaced bow and stern ends, which has a longitudinal middle that lies halfway between said vessel ends, and which has a vessel rear portion that extends longitudinally from said middle to said stern end, wherein said vessel has upper and lower decks that each has a surface area of at least one hundred meters$^2$, said lower deck having a rear region extending from said vessel middle to said stern, wherein:

said upper deck lies above a majority of said lower deck rear region that extends from said vessel middle to said stern, with said upper deck having an upper deck rear end that lies a plurality of meters forward of said stern and forward of a rear end of said lower deck;

said upper deck has a rear region that extends a majority of the distance from said vessel middle towards said stern;

said lower deck rear region is horizontal and has a predetermined height; and including a main winch and a stern roller with a stern roller top that lies no higher than one meter above said lower deck height;

an elongated member with a portion thereof that is held on said main winch and that is moving from said main winch along said lower deck region to said stern roller and from said stern roller into the sea, with a majority of the length of said elongated member that lies over said lower deck region lying directly under said upper deck rear region, so equipment can be stored on said upper deck above said moving elongated member and personnel can work on said upper deck rear region above said moving elongated member without danger of harm from said moving elongated member.

* * * * *